United States Patent [19]

Lagsdin

[11] Patent Number: 4,761,021

[45] Date of Patent: Aug. 2, 1988

[54] STABILIZER PAD FOR EARTHMOVING APPARATUS

[76] Inventor: Andry Lagsdin, 54 King Hill Rd., Hanover, Mass. 02339

[21] Appl. No.: 870,099

[22] Filed: Jun. 3, 1986

[51] Int. Cl.[4] ..... B60S 9/02

[52] U.S. Cl. ..... 280/764.1; 212/189

[58] Field of Search ..... 280/764.1; 212/189

[56] References Cited

U.S. PATENT DOCUMENTS

| | | | |
|---|---|---|---|
| 3,495,727 | 2/1970 | Long | 212/189 |
| 3,721,458 | 3/1973 | Mitchell | 280/764.1 |
| 3,897,079 | 7/1975 | MacKenzie et al. | 280/764.1 |
| 3,913,942 | 10/1975 | MacKenzie et al. | 280/764.1 |
| 4,039,206 | 8/1977 | Nault | 212/189 |
| 4,546,996 | 10/1985 | Hanson | 212/189 |

*Primary Examiner*—John J. Love
*Assistant Examiner*—Eric D. Culbreth
*Attorney, Agent, or Firm*—Wolf, Greenfield & Sacks

[57] ABSTRACT

Earthmoving equipment especially of the loader/-backhoe type is provided with hydraulically operated stabilizer arms having stabilizer members associated therewith. Each member or pad is of reversible type having a flanged surface for engagement with gravel, for example, in a somewhat resilient surface for engagement with concrete or asphalt for example. The resilient surface is formed by a laminate constructed of separate pieces each of synthetic rubber cord construction.

12 Claims, 3 Drawing Sheets

STABILIZER PAD FOR EARTHMOVING APPARATUS

BACKGROUND OF THE INVENTION

The present invention relates in general to a stabilizer pad for use with earthmoving apparatus. More particularly, the present invention concerned with a stabilizer pad that is reversible so that it may be usable on either concrete, for example or a more yielding surface such as gravel. Even more particularly, the present invention relates to a reversible stabilizer pad of improved construction having improved resilient pad construction that is very durable and long-lasting in use.

Reference is now made herein to U.S. Pat. Nos. 3,897,079 and 3,913,942 both relating to stabilizer pads relating to earthmoving apparatus. These prior art patents, in which I am a co-inventor, illustrate a reversible stabilizer pad having a generally flanged surface for engagement with gravel, for example, and a somewhat resilient surface for engagement with concrete or asphalt, for example. U.S. Pat. No. 3,897,079, for example describes the use of rubber pads or stops 38 on one side of the stabilizer member such as illustrated in FIG. 2 of this patent.

In the past these have been constructed of a molded rubber and although operation therewith has been satisfactory, for some applications the service life of the molded pad is too short particularly when these pads are used on larger machines. The molded rubber pad can be destroyed particularly if the surface upon which the pad is used is somewhat abrasive. It was common for a small tear to develop in the molded rubber pad and after use thereof the pad might come apart in chunks.

Accordingly, it is an object of the present invention to provide an improved reversible stabilizer pad for use with earthmoving apparatus and in particular one that employs a laminated pad.

Another object of the present invention is to provide an improved stabilizer pad construction that is of laminated form and that is more durable and has a longer operable life than with the use of a molded rubber pad.

Another object of the present invention is to provide an improved stabilizer pad construction that is of laminated form and that can be assembled to the overall pad construction quite easily.

Another object of the present invention is to provide an improved stabilizer pad that is more compact in construction without sacrificing the strength and durability of the pad.

SUMMARY OF THE INVENTION

To accomplish the forgoing and other objects features and advantages of the invention, there is provided an improved stabilizer pad construction for use with earthmoving apparatus or for other related applications. The improved pad construction of the present invention is preferably for use with a reversible stabilizer pad but may also find use in connection with other stabilizer pad applications. In connection with the reversible stabilizer pad construction, each pad is formed with opposed surfaces, one of the surfaces having flange means extending therefrom and the other of the surfaces having resilient means associated therewith. The pad is supported by means which permit reversal of the pads so that either of the surfaces may be the downwardly facing surface.

In accordance with the invention the resilient means is in the form of a laminated pad and constructed of a separate synthetic rubber pieces that are preferably formed from truck tire side walls so that each of the pieces is comprised of a synthetic rubber supported on a base cord. Angle iron means forms a pocket for receiving the laminated pad and means are provided for securing the rubber/cord laminate pieces within the angle iron pocket. The angle iron pocket then in turn is supported from the stabilizer member.

BRIEF DESCRIPTION OF THE DRAWINGS

Numerous other objects features and advantages of the invention should now become apparent upon a reading of the following detailed description taken in conjunction with the accompanying drawings in which.

DETAILED DESCRIPTION

Figure 1:
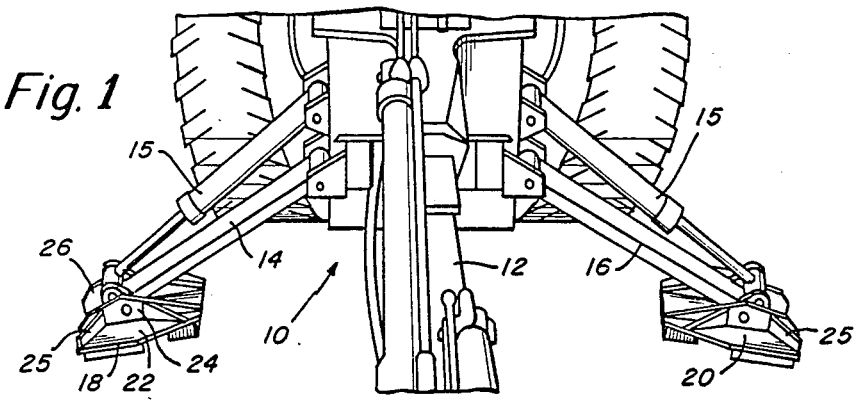
FIG. 1 is a fragmentary view of a typical loader/-backhoe that may embody the stabilizer pads of this invention.

FIG. 1 is a fragmentary view of a typical loader/-backhoe 10 showing a shovel mechanism 12, stabilizer arms 14 and 16, and associated stabilizer pads 18 and 20. A hydraulic piston 15 may operate each of the stabilizer arms 14 and 16 independently. When the equipment is being moved the pistons associated with each cylinder are withdrawn so that the support arms are elevated above ground level. Alternatively, when the support arms are to be used the pistons associated with each of the cylinders are extended to the position as substantially shown in FIG. 1.

The stabilizer pad 18 generally includes a flat plate 22 having extending normal to the surface thereof the flanges 24 and 26 extending from one surface of the plate 22. The support member is also provided with supporting ribs 25, two such ribs being provided for providing additional support for each of the flanges 24 and 26 in the embodiment of FIG. 1.

Figure 2:
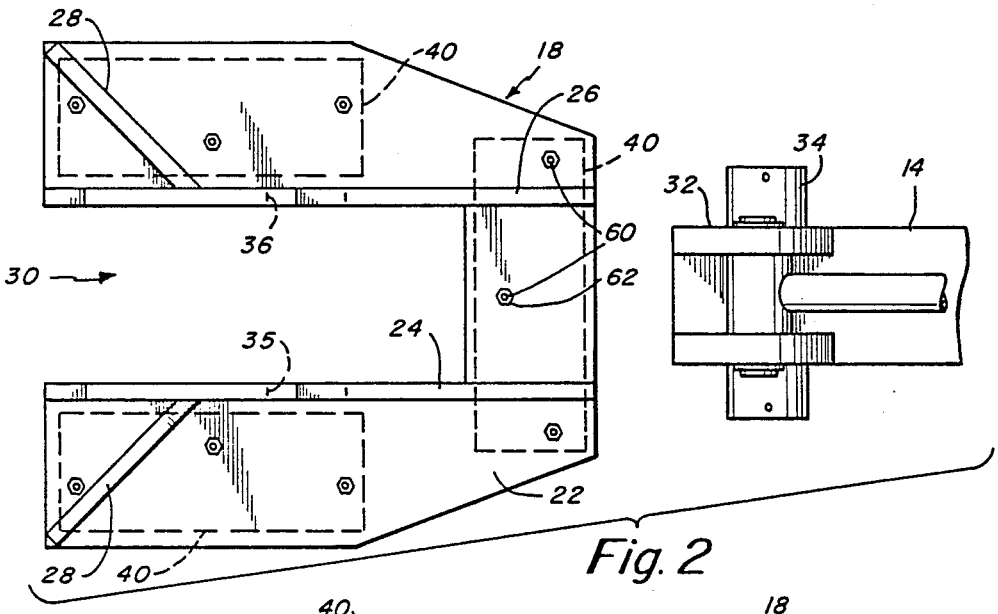
FIG. 2 is an exploded view illustrating the flanged side of the stabilizer pad with the associated support arm.
Figure 3:
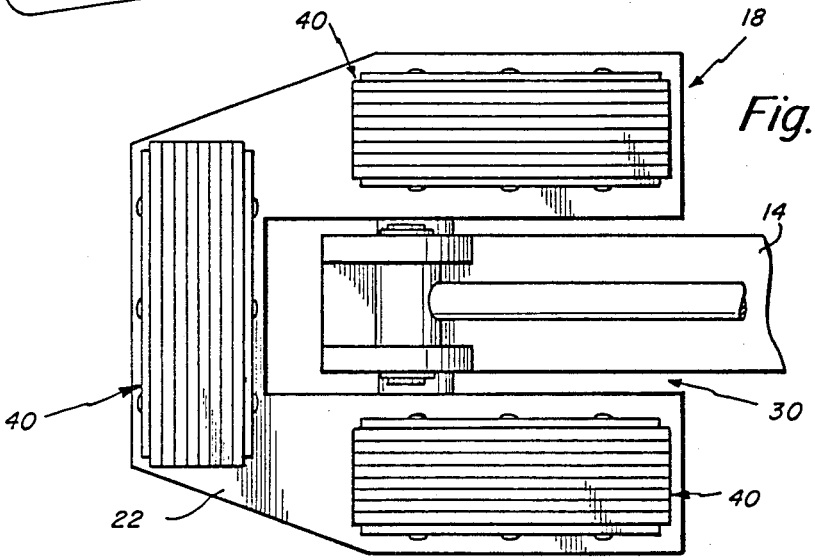
FIG. 3 is a view of the reverse side of the showing the improved resilient laminate construction.

In connection with the embodiment of FIG. 1, it is noted that the stabilizer member construction is substantially identical to that described in U.S. Pat. No. 3,897,079. However, in a preferred embodiment of the present invention the stabilizer member construction is substantially as illustrated in FIGS. 2 and 3 which is a slightly different configuration than that illustrated in FIG. 1. In the embodiment FIGS. 2 and 3 there is likewise provided a flat plate 22 having flanges 24 and 26 extending therefrom. In the embodiment illustrated in FIG.2 it is noted that there is one rib 28 on either side of the stabilizer member.

The plate 22 is notched at 30 between flanges 24 and 26 so as to accommodate arm 14. Arm 14 includes a journal end for accommodating pin 34. Pin 34 also fits within holes 35 and 36 of flanges 24 and 26, respectively. The pin 34 may be secured in place by means of a typical cotter pin, or the pin 34 may be threaded to accommodate a bolt.

FIG. 3 shows the resilient side of the stabilizer member which comprises resilient means in the form of laminated pads 40.

Figure 5:
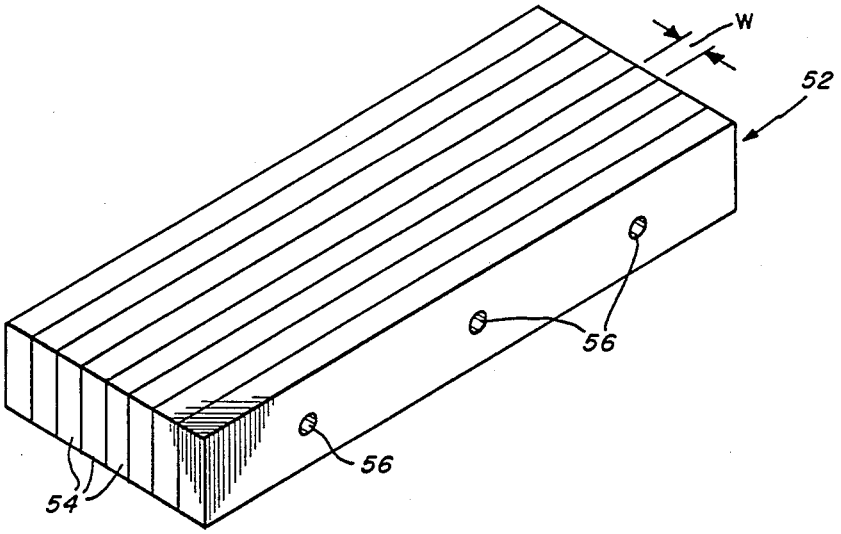
FIG. 5 is a perspective view illustrating the multiple rubber/cord pieces that comprise the laminate.
Figure 4:
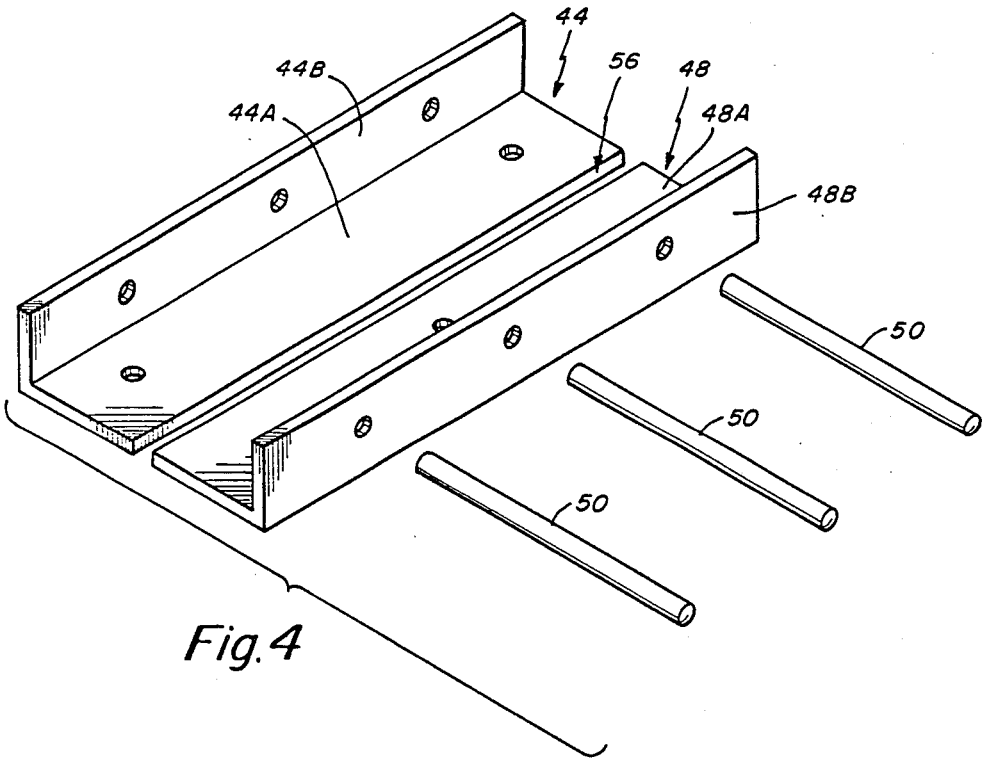
FIG. 4 is a perspective view illustrating a portion of the pad of the invention in particular illustrating the angle irons and securing pin.

Reference is now made to FIGS. 4 and 5 that together illustrate the basic components comprising the stabilizer member resilient pad structure. FIG. 4 illustrates the angle irons 44 and 48. The angle iron 44 includes a base leg 44A and an upright leg 44B. Similarly, the angle 48 contains a base leg 48A and an upright leg 48B. The upright legs 44B and 48B each have holes therein illustrated in FIG. 4 for receiving the elongated pins 50.

FIG. 5 illustrates the laminate structure 52 which generally comprises a plurality of separate pieces 54 shown arranged in a sandwich or laminate construction. Each of the pieces may be pre-drilled with a hole such as illustrated at 56 in FIG. 5 to receive the corresponding pins 50.

Each of the pieces 54 is preferably made from sidewall segments of a truck-tire carcasses. In this connection it is preferred not to use a steel belted tire for forming these simply because it is more difficult to cut a steel belted tire into such pieces. Each of the pieces 54 may have a thickness as illustrated by the dimension W in FIG. 5 that is preferably on the order of $\frac{1}{2}$ inch in its uncompressed state, and preferably in the range of $\frac{1}{4}$ to $\frac{3}{4}$ inch thickness. In a typical installation 8 to 10 pieces 54 may be employed in the laminate. Of course, for larger pads than the number of pieces would be increased.

It is preferred to use segments from a truck tire so that each of the individual pieces are of proper thickness to provide proper durability and stiffness. Typically, truck tires are of 10 ply or greater. It is preferred to use a multiple ply truck tire because this provides a relatively high ratio of cord to rubber relative thickness. The thickness of the cord that provides the primary stability is preferably 4 times that of the thickness of the rubber. The greater the ply number of the tire the greater the stability of the laminate.

Figure 6:
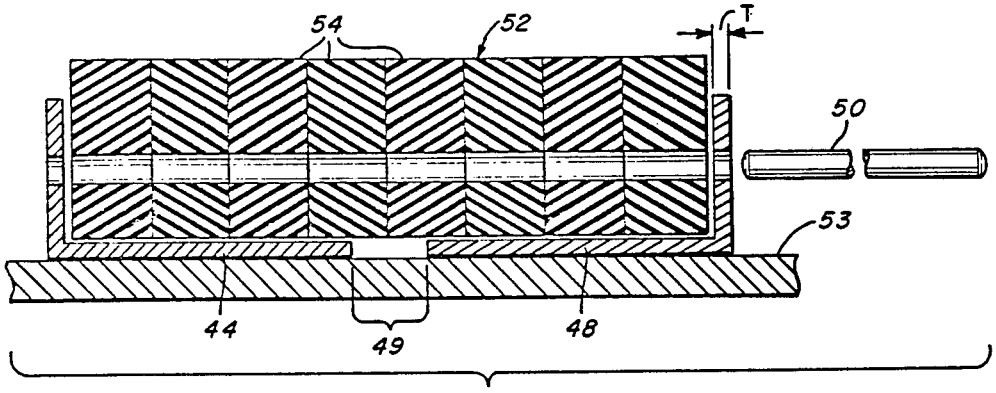
FIG. 6 is a cross-sectional view through the pad construction in an early step of assembly.
Figure 7:
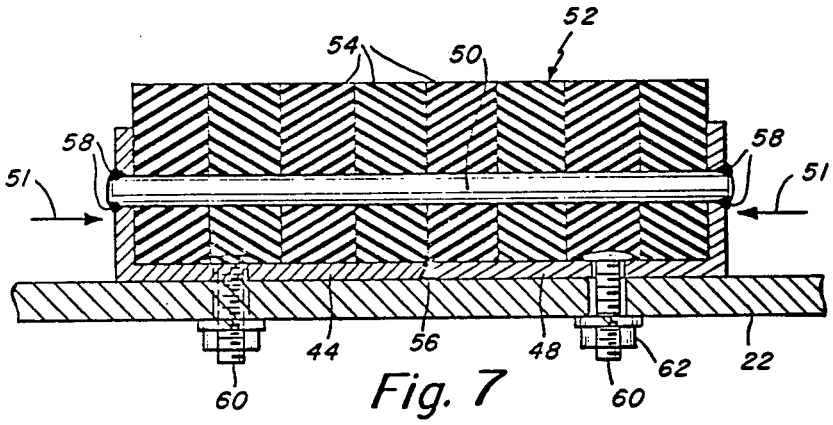
FIG. 7 is a similar cross-section view in a later step of construction in which the laminate has been compressed and the pins secured as well as the securing of the angle iron together.
Figure 8:
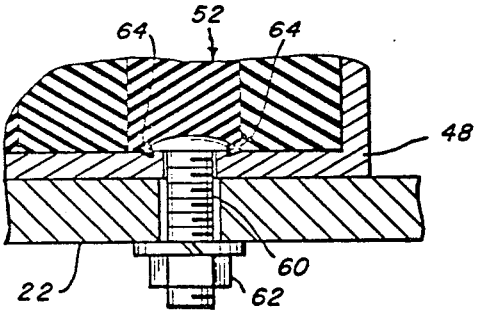
FIG. 8 is a fragmentary view illustrating the means by which the pads are secured to the stabilizer member.

Reference is now made to FIGS. 6–8 showing certain sequences in the method of assembly. In this connection it is noted that in FIG. 6 the angle irons 44 and 48 are disposed on some suitable support table 53. The pieces 54 of the laminate 52 are disposed in position and are considered in FIG. 6 as in their initial uncompressed state. The holes in each of the pieces 54 may be aligned so as to receive the pins 50. In FIG. 6 one of the pins 50 is illustrated exploded to the right of the structure. It is also noted in FIG. 6 that the bases of the angle irons 44 and 46 are spaced from each other as illustrated by the gap 49 in FIG. 6.

The next step in the method of assembly is to compress the laminate by moving one or both of the angle irons so that the angle irons are brought together. This compresses the pieces 54 of the laminate 52. In this connection note in FIG. 7 the arrows 51 indicating the relative direction of movement for compression of laminate. With the angle iron compressed by use of some type of a conventional press arrangement, then the angle irons are welded at 56 longitudinally along the seam between the angle irons. In this connection also refer to FIG. 4 where, at 56, the place is illustrated where the weld would occur. At the same time the ends of each of the pins are also welded at 58. This is illustrated in FIG. 7. The pin ends are welded to the respective angle iron upright legs. The compression forces as indicated by the arrows 51 may then be released and then the laminate is then maintained in somewhat of a compressed state. The compression of the pieces 54 of the laminate 52 provide for a sturdy laminate that is relatively rugged and rigid.

FIGS. 7 and 8 also illustrate the means by which the improved resilient pad means of the present invention is secured to the stabilizer member. In this connection note in FIGS. 7 and 8 the flat plate 22 of the stabilizer member with there being provided bolts 60 and associated nut 62 that are used for this purpose. These are preferably carriage bolts and have a relatively small head. The carriage bolts, as illustrated in FIG. 8, are tack welded to the angle iron at 64.

After the angle irons have been welded and the pins 50 have also been welded to the angle irons, the carriage bolts 60 that have been previously tack welded may then be inserted into holes pre-drilled in the stabilizer member. The nuts 62 preferably with the use of a associated lock washers then secure the resilient pad means to the stabilizer member.

The angle irons themselves are preferably constructed so as to have a thickness that is sufficiently rugged to provided good support but that is not too thick it is preferred that this thickness, illustrated in FIG. 6 by the dimension T be about 3/16 inch. If the angle iron thickness is smaller than that it will not have sufficient strength. On the other hand if the angle iron thickness is substantially greater than that the angle iron itself, as the laminate wears, will tend to tear into the pavement particularly at the corners of the upright legs of the angle irons. The preferred 3/16 inch thickness provides sufficient flexibility so that if the angle iron does engage a hard surface such as asphalt or concrete surface it will tend to deflect rather than gouge the surface.

Figure 9:
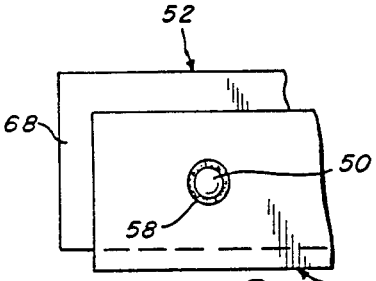
FIG. 9 is a fragmentary view illustrating one form of angle iron and laminate.
Figure 10:
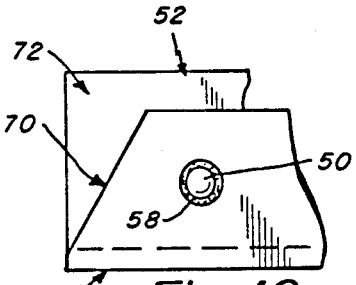
FIG. 10 shows a different form of angle iron in particular at the end thereof.

Reference is now made to FIGS. 9 and 10 which show two preferred ways of arranging the components as far as the angle iron and the laminate are concerned. It is of course preferred that the laminate extend above the angle iron as illustrated in FIGS. 9 and 10 and at the corners of the angle iron it is preferred that the laminate also extend beyond as illustrated at 68 in FIG. 9. This leaves sufficient room at the corner of the laminate so that even if the corners thereof wear there still will be sufficient room before the angle iron is exposed.

In this connection FIG. 10 shows an alternate construction in which the end of the angle iron; that is the upright wall of the angle iron is angled as illustrated at 70 in FIG. 10. This leaves a relatively large exposed area of laminate at 72 at the corners. With either of the arrangements of FIGS. 9 and 10, this prevents tearing of the pavement upon which the pad is used particularly at the corners thereof.

With regard to securing the resilient pad means to the stabilizer member itself, in one embodiment, such as illustrated in FIG. 2, three bolts 60 may be employed per pad. In the embodiment of FIG. 2 three such pads are illustrated. In another embodiment of the invention in which the overall stabilizer member is larger then a greater number of bolts may be employed. For example one version employs five bolts for securing purposes.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. For an earthmoving apparatus having at least one support arm, a stabilizer comprising a plate-like piece having alternate surfaces one of which is resilient and the other of which includes a flanged web, and means pivotally supporting said piece to an end of said arm, said piece being provided with a cut-away section, said piece being revolvable through at least 180° relative to said support means between alternative positions wherein either said resilient surface is facing downwardly or said flanged web is engaging the ground, said resilient surface defined by a resilient pad means of laminate construction including a plurality of stacked pieces and means for retaining the pieces in a fixed laminate array, said stacked pieces forming the laminate construction comprising rubber pieces with a cord base, said means for retaining comprising an open metal pocket comprised of a pair of angle irons having opposed ends between which the stacked pieces are compressed and base legs upon which the stacked pieces are held, said angle irons being forced together to compress the stacked pieces, pin means comprising a plurality of securing pins extending through holes in the opposed ends of the angle irons and also extending through holes in the laminate pieces while the angle irons are forced together, and weld means at the end of each securing pin to hold the pin at each end to the angle iron while maintaining the stacked pieces compressed.

2. An apparatus as set forth in claim 1 wherein said supporting means includes said a pin and flanged web accommodates said pin, said cut-out section permitting the revolution of said piece through on the order of 180°.

3. Apparatus as set forth in claim 2 wherein said flanged web on said piece has spaced flanges on opposite sides of said cut-out section including holes for accommodating said pin.

4. An apparatus as set forth in claim 1 in combination with bolt means secured to said angle irons extending through the base legs thereof and for securing said pad means to the plate-like piece.

5. An apparatus as set forth in claim 1 wherein said bolt means are welded to said base legs and are disposed in a pattern matching a hole pattern in said plate-like piece.

6. An apparatus as set forth in claim 5 wherein said pair of angle irons are joined at a common seam.

7. An apparatus as set forth in claim 6 wherein the angle irons are joined by welding between the base legs and facing respective edges thereof.

8. An apparatus as set forth in claim 1 wherein the stacked pieces forming the laminate construction extend beyond and out the ends of the angle iron.

9. An apparatus as set forth in claim 1 wherein the angle irons have slanted ends so as to provide additional exposure of the laminate pieces.

10. An apparatus as set forth in claim 1 wherein said stacked pieces each comprise multi-ply tire segment having a base cord and an associated rubber on the base cord.

11. A stabilizer member for use with an earthmoving apparatus for support from a stabilizing arm thereof, said stabilizer member comprising, a rugged metal support piece, means pivotally supporting said piece from said stabilizing arm, resilient pad means of laminate construction and including a plurality of stacked pieces secured to said support piece, said resilient pad means for engagement with a hard terrain surface, and means for securing the resilient pad means including metal retaining pocket means for receiving the stacked pieces so as to retain them in a fixed laminate array, said metal retaining pocket means having opposite ends for retaining the laminated pieces with the laminated pieces being in compressed state, said metal retaining means being formed by a pair of angle irons having the stacked pieces therebetween with the angle irons joined to form a fixed pocket, a plurality of pins extending through the angle irons and laminate pieces for retaining the angle irons in place and maintaining the stacked pieces compressed, weld means at the end of each securing pin to hold the pin at each end to the angle iron while maintaining th stacked pieces compressed, each stacked piece comprising a segment of a multi-ply tire including a base cord and associated rubber layer, the thickness of the angle iron being on the order of 3/16 inch and the thickness of each stacked laminate piece being on the order of $\frac{1}{4}$ inch - $\frac{3}{4}$ inch, in combination with bolt means comprising a plurality of bolts secured to the angle irons by being welded thereto and extending through the bottom legs thereof for securing the pad means to the stabilizer plate-like piece.

12. A stabilizer member as set forth in claim 11 wherein the ratio of cord thickness to rubber thickness of each stacked piece is 4 to 1.

* * * * *